US008298100B2

(12) United States Patent
Burnett et al.

(10) Patent No.: US 8,298,100 B2
(45) **Date of Patent: *Oct. 30, 2012**

(54) CUSTOM MILLED IRON SET

(75) Inventors: Michael Scott Burnett, Carlsbad, CA (US); Peter J. Gilbert, Carlsbad, CA (US); Bruce R. Pettibone, Carlsbad, CA (US); Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 20 days.

This patent is subject to a terminal disclaimer.

(21) Appl. No.: 12/868,499

(22) Filed: Aug. 25, 2010

(65) Prior Publication Data

US 2010/0318211 A1 Dec. 16, 2010

Related U.S. Application Data

(63) Continuation of application No. 11/691,081, filed on Mar. 26, 2007, now Pat. No. 7,785,218.

(51) Int. Cl.
*A63B 67/02* (2006.01)

(52) U.S. Cl. ..... 473/409; 473/131; 706/8; 706/52; 706/904

(58) Field of Classification Search ..... 473/151, 473/407, 409; 706/8, 52, 904; 463/32
See application file for complete search history.

(56) References Cited

U.S. PATENT DOCUMENTS 5,367,627 A 11/1994 Johnson
5,507,485 A 4/1996 Fisher
5,615,342 A 3/1997 Johnson
5,696,439 A 12/1997 Presti et al.
5,733,201 A 3/1998 Caldwell et al.
5,877,970 A 3/1999 Nesbit et al.
6,083,123 A 7/2000 Wood
6,086,487 A 7/2000 Morgan et al.
RE36,832 E 8/2000 Nagamine et al.
6,385,559 B2 5/2002 Boehm
6,421,612 B1 7/2002 Agrafiotis et al.
6,490,542 B2 12/2002 Boehm
6,602,042 B2 8/2003 Roy et al.
6,611,792 B2 8/2003 Boehm
6,658,371 B2 12/2003 Boehm et al.
6,672,978 B1 1/2004 Morgan et al.
6,760,685 B2 7/2004 Boehm
6,793,587 B2 9/2004 Liewellyn et al.
6,966,843 B2 11/2005 Rankin et al.
(Continued)

OTHER PUBLICATIONS

Qui, S.L. et al, "Conceptual Design Using Evolution Strategy," Advanced Manufacturing Technology, 2002, Springer-Verlag London Ltd.

(Continued)

*Primary Examiner* — Peter DungBa Vo
*Assistant Examiner* — Steve Rowland
(74) *Attorney, Agent, or Firm* — Randy K. Chang

(57) ABSTRACT

A process for the custom design and automated, custom manufacture of golf clubs. According to a first embodiment, a computer user interface, preferably a graphical user interface (GUI), guides a user's selection of preferred golf club design parameters. According to a second embodiment, input data about a golfer's style of play and golf club performance needs are captured from data collection systems, and analyzed by black box algorithms, preferably fuzzy logic algorithms, to infer golf club design parameters. After preferences for, or inferences about, golf club design parameters are developed in accordance with the two embodiments, a computer aided (CA) system is used to design and manufacture the desired golf clubs.

14 Claims, 6 Drawing Sheets

U.S. PATENT DOCUMENTS

| | | | |
|---|---|---|---|
| 7,033,539 | B2 | 4/2006 | Krensky et al. |
| 7,041,014 | B2 | 5/2006 | Wright et al. |
| 7,072,871 | B1 | 7/2006 | Tinnemeyer |
| 7,273,427 | B2 | 9/2007 | Inoue et al. |
| 2002/0059049 | A1 | 5/2002 | Bradbury et al. |
| 2004/0127303 | A1 | 7/2004 | Teraoka |
| 2004/0204257 | A1 | 10/2004 | Boscha et al. |
| 2004/0204262 | A1 | 10/2004 | White et al. |
| 2005/0069207 | A1 | 3/2005 | Zakrzewski et al. |
| 2006/0129462 | A1 | 6/2006 | Pankl et al. |
| 2006/0166737 | A1 | 7/2006 | Bentley |
| 2006/0166757 | A1 | 7/2006 | Butler, Jr. et al. |
| 2007/0010341 | A1 | 1/2007 | Miettinen et al. |
| 2007/0270214 | A1 | 11/2007 | Bentley |
| 2009/0222206 | A1 * | 9/2009 | Burns et al. ..... 702/1 |

OTHER PUBLICATIONS

Yan, Wei et al., "Product Concept Generation and Selection Using Sorting Technique and Fuzzy C-Means Algorithm," Computers and Industrial Engineering, 2006, Elsevier, Ltd.

* cited by examiner

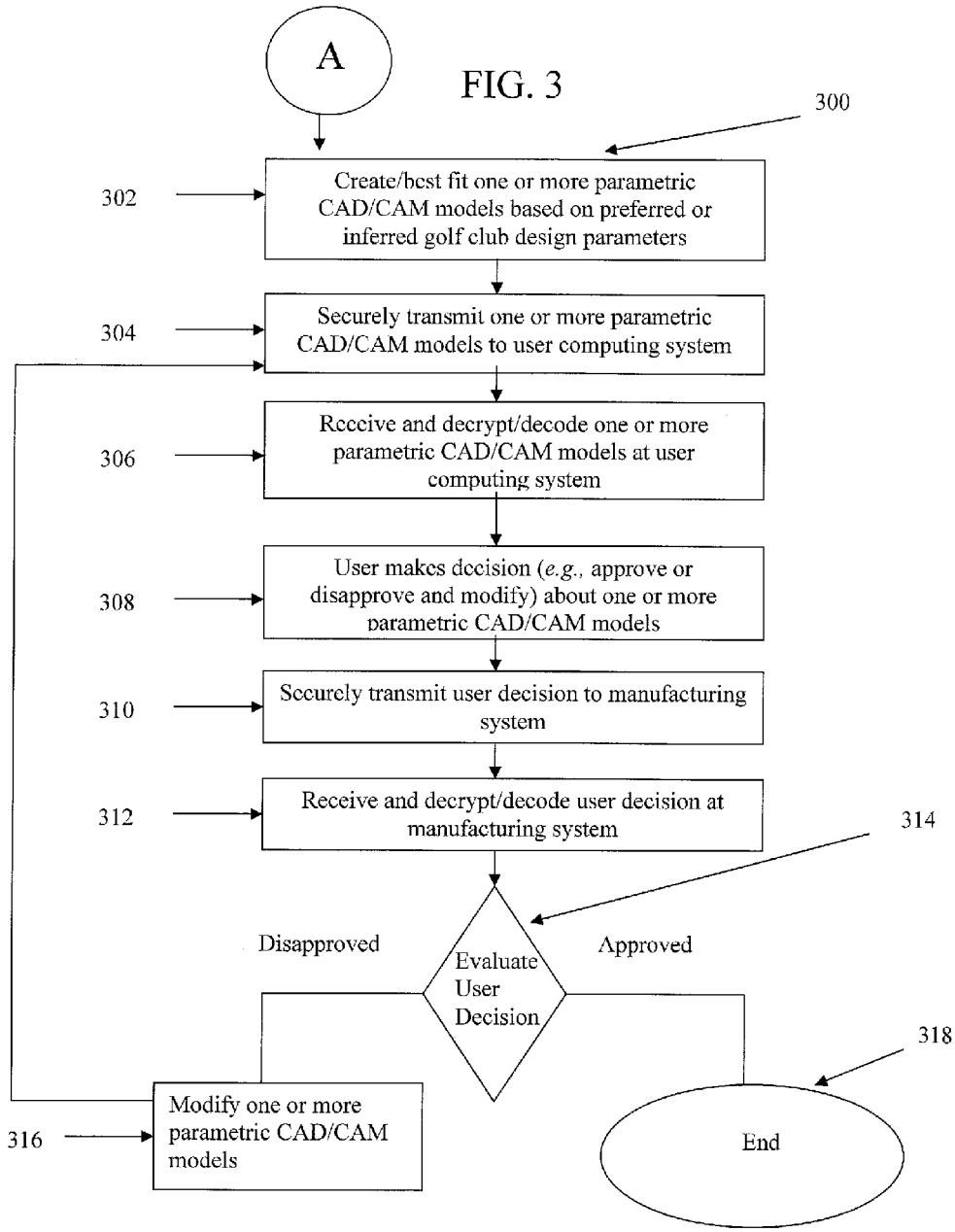
A
FIG. 3
300
302
Create/best fit one or more parametric CAD/CAM models based on preferred or inferred golf club design parameters
304
Securely transmit one or more parametric CAD/CAM models to user computing system
306
Receive and decrypt/decode one or more parametric CAD/CAM models at user computing system
308
User makes decision (e.g., approve or disapprove and modify) about one or more parametric CAD/CAM models
310
Securely transmit user decision to manufacturing system
312
Receive and decrypt/decode user decision at manufacturing system
314
Disapproved
Evaluate User Decision
Approved
318
316
Modify one or more parametric CAD/CAM models
End

CUSTOM MILLED IRON SET

CROSS-REFERENCE TO RELATED APPLICATION

The present application is a Continuation of U.S. patent application Ser. No. 11/691,081 filed on Mar. 26, 2007, now U.S. Pat. No. 7,785,218 the disclosure of which is hereby incorporated by reference in its entirety.

FIELD OF THE INVENTION

The invention relates generally to the custom design and manufacture of golf clubs. In particular, the invention relates to using graphical user interface (GUI) to guide the user in customizing a set of irons and black box algorithms, such as fuzzy logic methods for custom designing a set of irons based on user inputs and measurements, which are then manufactured using an automated computer system.

BACKGROUND OF THE INVENTION

Golf players vary in size, skill, style, and preference. Therefore, different golf equipment suits the needs of different players. To meet these needs, golf club manufacturers produce clubs in various configurations, including different head designs and shaft lengths.

Simple methods for custom fitting a golfer to the most existing suitable golf clubs have been discussed in the art. For instance, one may specify which pre-existing components are to be used in building the golf clubs, or one may select design parameters for hand grinding golf clubs. For example, Titleist® allows users to select custom shafts for their clubs, and the Titleist® FittingWorks program allows selection of the best fit equipment from tee to green.

Various other custom fitting methods have also been in the patent literature. For example, U.S. Pat. No. 6,083,123 discloses a computer implemented method for fitting golf clubs for golfers to accommodate the swing behavior of an individual's golf swing using combinatorial logic at both global and local levels, and the suggested golf club specifications are derived at the intersection of two different computer models. Similarly, U.S. Pat. No. 7,041,014 discloses a method for matching a golfer with a particular golf club style by using a golfer's performance characteristics to infer an appropriate golf club style. Moreover, U.S. Patent Application Publication No. 2006/0166757 discloses a method for selecting optimum club head design parameters using lookup tables and mathematical algorithms.

Although the aforementioned publications disclose how golf clubs may be custom fitted to a golfer, the prior art does not disclose a graphical process or fuzzy logic process that allows a consumer to custom design a set of golf clubs.

SUMMARY OF THE INVENTION

The present invention relates to a graphical computer system that communicates interactively with a user in real time to custom design golf clubs.

The present invention also relates to a system that uses a language based logic or a fuzzy logic system that captures or mimics the technical know-how and the artistic knowledge of skilled golf club designers, and along with the user inputs and/or measurements custom designs golf clubs for the user.

The present invention further relates to a system that provides for the custom manufacture of golf clubs using an automated process that creates computer aided design models, which are subsequently used to fabricate one or more golf club heads.

BRIEF DESCRIPTION OF THE DRAWINGS

In the accompanying drawings, which form a part of the specification and are to be read in conjunction therewith and in which like reference numerals are used to indicate like parts in the various views:

FIG. 3 is a flowchart illustrating the steps of an iterative method for generating parametric CAD/CAM models of golf clubs.

DETAILED DESCRIPTION OF THE INVENTION

Figure 1A:
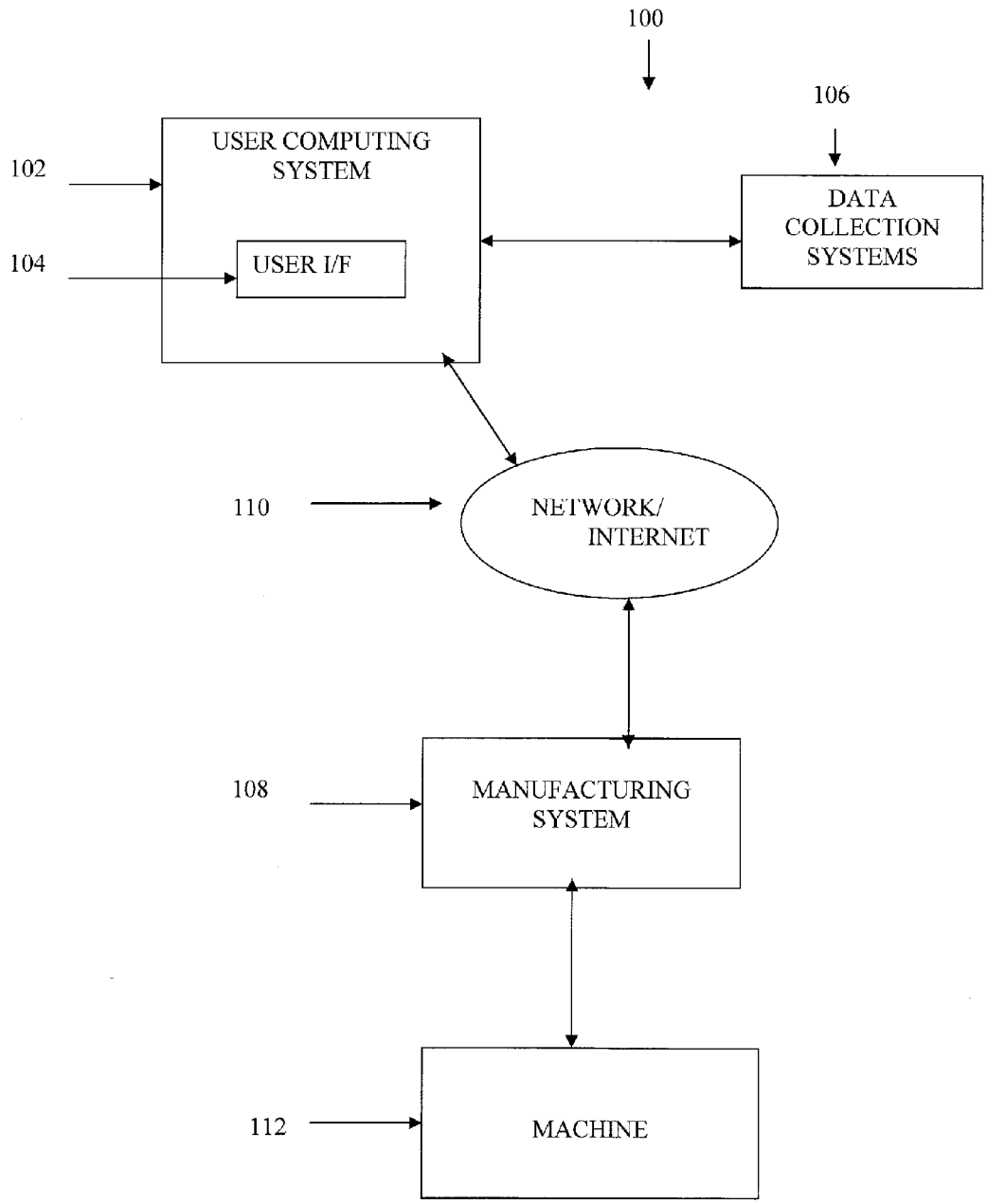
FIG. 1A is a high level block diagram of a system to custom design and manufacture golf clubs.
Figure 1B:
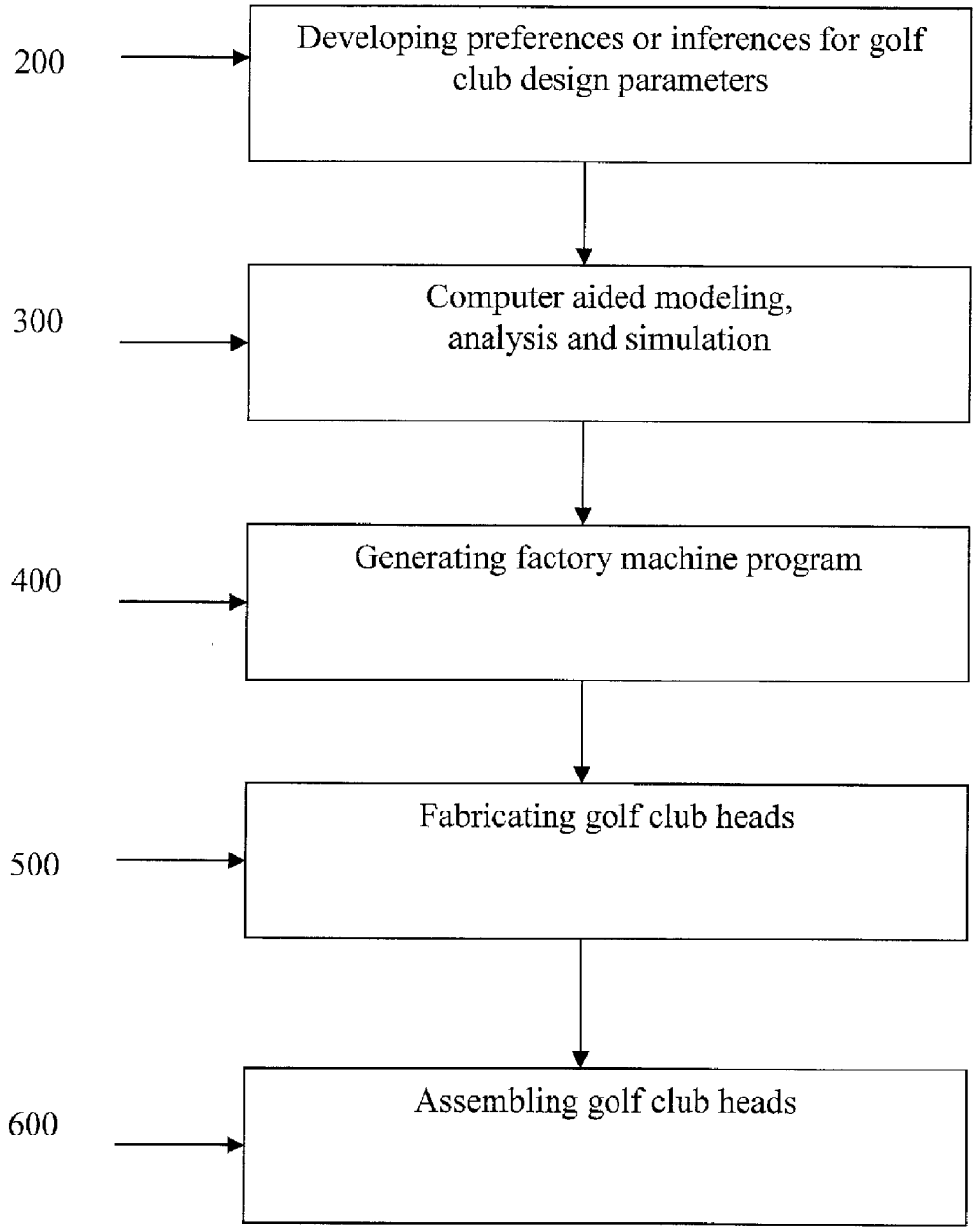
FIG. 1B is a high level flowchart illustrating information flow in the system to custom design and manufacture golf clubs.

The present invention is directed to a process for the custom design and manufacture of golf clubs. An overview of the process is depicted in FIGS. 1A and 1B. According to a first embodiment, a user interface 104, preferably a graphical user interface (GUI), guides a user's selection of preferred golf club design parameters. The GUI is preferably a screen display that can show a golf club head in three-dimension and can rotate the club/club head about a plurality of axes, so that the user can have accurate visual appreciation of the customized golf clubs. The user's choices are limited to off-the-shelf components or designs in order to facilitate the manufacture of the clubs. According to a second embodiment, input data about a golfer's style of play and golf club performance needs are captured from data collection systems 106, and analyzed by black box algorithms, preferably fuzzy logic algorithms, to infer golf club design parameters. In this second embodiment, a user has more choices to customize golf club design parameters. After preferences for, or inferences about, golf club design parameters are developed in accordance with the two embodiments, a computer aided (CA) system is used to design and manufacture the desired golf clubs.

I. General Overview

FIGS. 1A and 1B can generically describe both the first and second embodiments. Referring now to the drawings in greater detail, FIG. 1A is a block diagram of a system 100 for the custom design and manufacture of golf clubs. The illustrated system 100 comprises a user computing system 102, a user interface 104, and one or more data collection systems 106 that are coupled to a manufacturing system 108, via a network 110 (e.g., the Internet or an Intranet). The manufacturing system 108 is connected to milling machine 112 that fabricates the golf clubs. Further discussion of such automated computer manufacturing systems is found in U.S. Patent Application Publication No. 2006/0129462, which is incorporated herein by reference in its entirety.

The illustrated system 100 may perform or facilitate a number of functions, including those illustrated in FIG. 1B. In phase 200, as discussed in greater detail below, preferences or inferences for golf club design parameters are developed in two alternative embodiments of the present invention. In phase 300, the preferred or inferred golf club design parameters are used for modeling, analysis, and simulation, e.g., by a computer aided (CA) computer system such as a computer aided design and computer aided manufacturing (CAD/CAM) system. In phase 400, a factory machine program is generated for fabricating golf club heads. In phase 500, golf club heads are fabricated by techniques such as CNC-milling or rapid prototyping. In phase 600, golf clubs are assembled using the fabricated golf club heads and other golf club components.

II. Golf Club Design Parameters

Figure 2A:
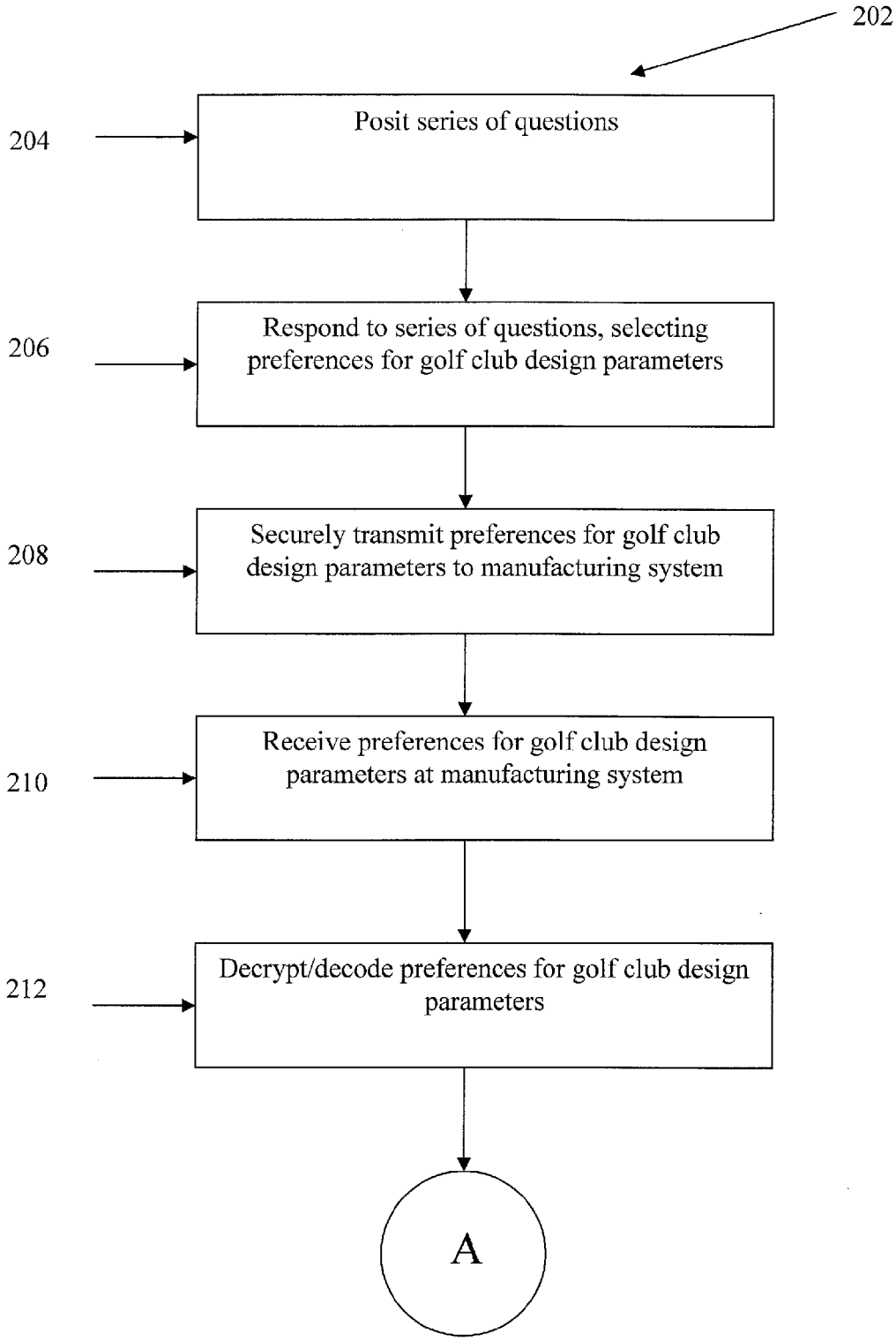
FIG. 2A is a flowchart illustrating a method for selecting preferences for golf club design parameters.
Figure 2B:
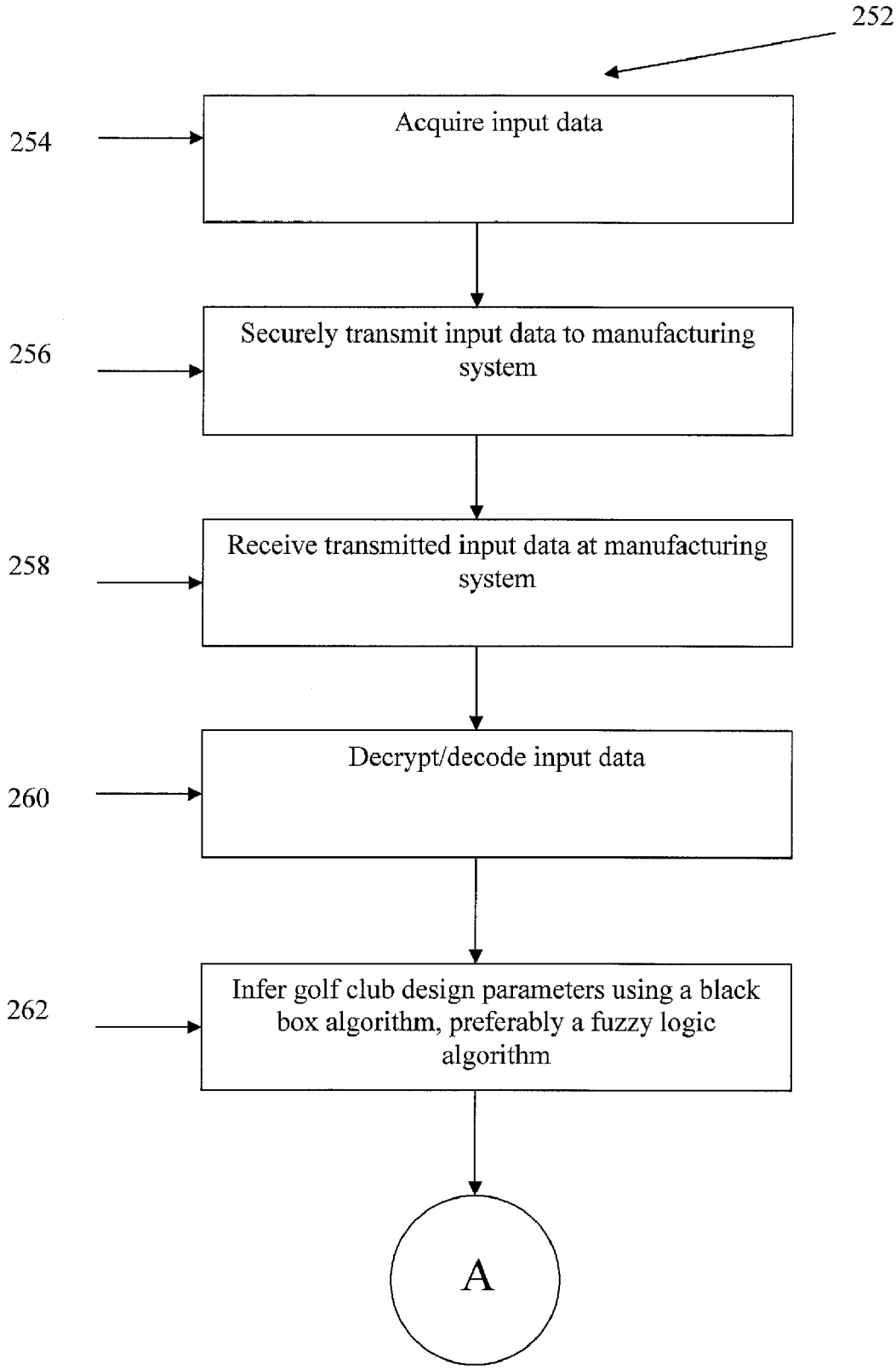
FIG. 2B is a flowchart illustrating a method for inferring preferences for golf club design parameters.

FIGS. 2A and 2B are flow diagrams showing steps of phase 200, in accordance with two alternate embodiments of the present invention, whereby preferences for, or inferences about, golf club design parameters are developed. In the first embodiment, illustrated in FIG. 2A, a user's preferences for select golf club design parameters are acquired by a user interface, preferably a graphical user interface (GUI). In the second embodiment, illustrated in FIG. 2B, a black box algorithm, preferably a fuzzy logic algorithm, infers a broad range of golf club design parameters.

The preferred or inferred golf club design parameters may be directed to the design of any type of golf club, including drivers, fairway clubs, utility clubs, irons, wedges, and putters. Moreover, the preferred or inferred golf club design parameters may be directed to the design of any component of a golf club, including the head, the shaft, and the grip.

A. First Embodiment

FIG. 2A shows the different steps of a method 202 in accordance with the first embodiment of the present invention, whereby preferences for golf club design parameters are developed. In step 204, the user interface 104 posits a series of questions to a user that aids in identifying preferred golf club design parameters. The user interface 104 may be any interface known to an ordinary person of skill in the art, but is preferably a graphical user interface (GUI), and more preferably a GUI that employs web-based software. The GUI preferably can display the golf club or club head as it is being customized. Preferably, every time a user adds or changes a feature, a revised image is displayed for the user to approve or to make further changes. Further discussion of an interactive process for fitting golf equipment can be found in commonly owned U.S. Pat. No. 6,672,978, which is incorporated herein by reference in its entirety.

In order to facilitate the golf club manufacturing process, the series of questions, as posited in step 204, are limited to eliciting a user's design preferences for off-the-shelf golf clubs or components thereof. For example, the series of questions that guides a user's selection may include the following golf club design parameters: profile, sole design (i.e., bounce angle, sole camber, leading edge radius, and sole width), groove, top line (i.e., top line width and crown radius), offset, and finish. When positing the series of questions in step 204, the user interface 104 can display after each selection, or after all or some of the selections are made, how a golf club would be configured if a user chose one or more golf club design parameters.

In step 206, the user responds to the series of questions by choosing preferred options for golf club design parameters, including, but not limited to, the options listed below in Table 1. The options available for each golf club design parameter can be either discrete selections or entered values within a prescribed range. For instance, options for a face profile would likely be selected from a discrete list of options (e.g., standard toe, square toe, or round toe), whereas options for offset would likely be entered as a specific value within a prescribed range. After a user chooses his or her preferred options for golf club design parameters, the user interface 104 displays the configuration of one or more resultant golf clubs. The user interface 104 provides the option of modifying the selected golf club design parameters should the user desire to do so.

Table 1 lists examples of possible golf club design parameters, possible options, and criteria for choice. As indicated in Table 1, the golf club design parameters may be grouped into different categories (i.e., primary parameters, secondary parameters, and tertiary parameters), indicating the relative importance of each golf club design parameter in the design and manufacture of the golf clubs. Additional golf club design parameters, options, and criteria for choice are also possible.

TABLE 1

| Golf Club Design Parameter | Possible Options | Criteria for Choice |
|---|---|---|
| | Primary Parameters | |
| Profile | Round, Traditional, Square | Aesthetics |
| Sole Design: Bounce Angle | Various Values | Swing Plane/Turf |
| Sole Design: Sole Camber | Various Values | Swing Plane/Turf |
| Sole Design: Leading Edge Radius | Various Values | Swing Plane/Turf |
| Sole: Sole Width | Various Values | Swing Plane/Turf |
| Groove | U-shaped, U/V-shaped, V-shaped | Ball Type/Ball Speed |
| Top Line: Width | Various Values | Psychological, Aesthetics |
| Top Line: Crown Radius | Various Values | Psychological, Aesthetics |
| | Secondary Parameters | |
| Offset | Various Values | Flight, Aesthetic Tuning |
| | Tertiary Parameters | |
| Finish | Scratch, Satin, Bright, Color | Cosmetic |

In step 208, the user computing system 102 securely transmits the selected golf club design parameters via a network 110 to a manufacturing system 108 at a remote site. In step 210, the manufacturing system 108 receives the transmitted golf club design parameters. Subsequently, in step 212, the manufacturing system 108 decrypts, decodes and/or otherwise gains access to the transmitted golf club design parameters. Further discussion about the interaction between a user computing system and a manufacturing computing system may be found in U.S. Patent Publication No. 2002/0059049, which is incorporated herein by reference in its entirety.

B. Second Embodiment

FIG. 2B shows the different steps of a method 252 in accordance with the second embodiment of the present invention, whereby inferences for golf club design parameters are developed using black box algorithms, preferably fuzzy logic algorithms. Such algorithms, discussed in greater detail below, are applied to data acquired in step 254 from one or more data collection systems 106. The data collection systems 106 may include, but are not limited to, one or more dynamic data capturing systems (e.g., a club/ball launch monitor, an impact analysis system, a shaft load analysis system, a light and reflective dot technology system, etc.), a system for collecting basic dynamic fit measurements, and an interview/questionnaire. In contrast to the first embodiment, the different data collection systems of the second embodiment allow one to infer a broader range of golf club design parameters.

1a. Data Collection Systems: Dynamic Data Capturing System

The primary data collection system 106 is a dynamic data capturing system, preferably a club/ball launch monitor such as the Titleist® Launch Monitor. Any suitable club/ball launch monitor can be used. A club/ball launch monitor can analyze a golfer's swing to capture input data, representing measurements of a plurality of input parameters. The input data can capture information from both a golfer's club presentation and ball launch conditions.

A club/ball launch monitor can capture a plurality of input parameters from golf club's presentation including club head speed data, acceleration/tempo data, club path data, angle of attack data, effective loft data, face angle data, and rotational speed data. A club/ball launch monitor can also capture a plurality of input parameters from a golf ball's launch conditions including data corresponding to ball speed, ball speed standard deviation, both the normal and tangential components of the force vector, efficiency, launch angle, backspin, spin rate, and departure angle.

In addition to a club/ball launch monitor, other dynamic data capturing systems can include an impact analysis system, a shaft load analysis system, and a light and reflective dot technology system. These additional dynamic data capturing systems can serve as secondary sources of input data.

1b. Data Collection Systems: Basic Dynamic Fit Data

Besides dynamic data capturing systems, the present invention is also directed to systems for collecting basic dynamic fit data. Such systems can use interviews or measurements (e.g., measurements from a tape marking system) to capture a plurality of input parameters including input data pertaining to a club's lie angle, length, grip size, and shaft type. The lie angle can be measured by the ground/sole contact position. The club length can be measured by the ball/club face impact position. The grip size data can be measured by means of the golfer's hand size. The shaft type data comprises information about the shaft flex, shaft torque, shaft construction (i.e., whether the shaft is metal, graphite, or a composite), and shaft weight (e.g., 30-140 grams).

1c. Data Collection Systems: Interview/Questionnaire

Another data collection system 106 can be an interview or questionnaire about a golfer's performance needs and preferences. The interview can comprise questions designed to elicit input data representing measurements of a plurality of input parameters, including a golfer's skill, typical ball flight, typical course conditions, biomechanical attributes, profile preference, offset preference, head design preference, top line preference, spin/groove preference, finish preference, swing attack angle, and ball type.

Interview questions about a golfer's skill may include queries about a golfer's handicap as well as strengths and weaknesses. Input data representing measurements of a golfer's handicap may range from +5 to −30. Interview questions relating to a golfer's strengths and weaknesses may ask a golfer to rate his or her consistency with long irons, mid irons, short irons, and wedges on a scale (1 very good-10 poor).

Interview questions about a golfer's typical ball flight may include queries about preferences for ball height and curvature. The height reached by a golf ball may be classified as high, medium, or low. A golf ball's curvature may be categorized as fade, straight, or draw, and, thereafter, be assigned a value of mild, moderate, or extreme.

Interview questions about a golfer's typical course conditions may include queries about fairways, the green, bunkers, wind, and hazards. One may classify conditions on the fairways as hard/dry, moderate, or soft/wet. One may classify the speed of the green as fast, moderate, or slow. One may classify the quantity (few 1-many 10) and type (soft 1-hard 10) of bunkers. One may classify the frequency (never 1-always 10) and strength (mild 1-heavy 10) of the wind. One may classify the quantity of hazards (few 1-many 10).

Interview questions about a golfer's biomechanical attributes may include queries, designed to elicit discrete measurements for knuckle to ground height, distance hit, glove size, jacket size, height, and physical limitations on the swing. The distance hit may be recorded, in terms of yards, for a 3-iron, 6-iron, and 9-iron.

Interview questions about a golfer's profile preference may ask whether a golfer prefers a round, square, or traditional profile. Interview questions about a golfer's offset preference may record discrete values (e.g., for a 3-iron, the offset preference may be recorded as 0.340, 0.240, or 0.140 inches). Interview questions about a golfer's head design preference may ask whether one prefers muscle back, mid-sized cavity back, or oversized cavity back clubs. Generally, the face area increases from muscle back to mid-sized to oversized club heads. For example, mid-sized clubs may have a face area that is about 3 to about 10 percent larger than the face area of traditional or standard muscle back club heads and oversized clubs may have a face area that is at least about 10 percent, and preferably between about 10 and 25 percent, larger than the face area of traditional or standard sized muscle back club heads. Generally, face area is the entire flat region of the front face of the club head. Additionally, mid-sized club heads having a cavity back may generally have a cavity volume of at least 8 cc and the oversized club heads may generally have a cavity volume of at least 10 cc, and preferably at least 12 cc. Interview questions about a golfer's top line preference may record discrete values for top line width (e.g., 0.420, 0.350, 0.280, 0.230, and 0.180 inches) and crown radius (e.g., 20, 3, 1, and 0.25 inches). Interview questions about a golfer's spin/groove preference may record values such as low, medium, or high. Interview questions about a golfer's golf club finish preference may record values such as bright, satin, or scratch.

Interview questions about a swing attack angle may note discrete values recorded from a launch monitor such as the Titleist® Launch Monitor, or be recorded as a function of the divot. The swing attack angle may also be categorized as shallow, medium, or steep.

Interview questions about the ball type may note whether a golfer's golf ball is a 2 piece golf ball designed for improved distance (e.g., Titleist® NXT), a 3 piece golf ball designed for improved distance/feel (e.g., Titleist® NXT Tour), a 3 piece golf ball designed for improved high spin (e.g., Titleist® Pro V1), or another type of golf ball.

2. Collection and Transmission of Data

In step 256, the input parameters, collected from the data collection systems 106, are securely transmitted via a network 110 to a manufacturing system 108 at a remote site. The input parameters may be transmitted directly from the data collection systems 106, or indirectly by connecting the data collection systems 106 to user computing system 102, which then transmits the input parameters over network 112. In step 258, the manufacturing system 108 receives the transmitted input data. Subsequently, in step 260, the manufacturing system 108 decrypts, decodes and/or otherwise gains access to the transmitted input data. Further discussion about the interaction between a user computing system and a manufacturing computing system may be found in U.S. Patent Publication No. 2002/0059049, which was previously incorporated by reference in its entirety.

3. Overview of Fuzzy Logic Models

Figure 2C:
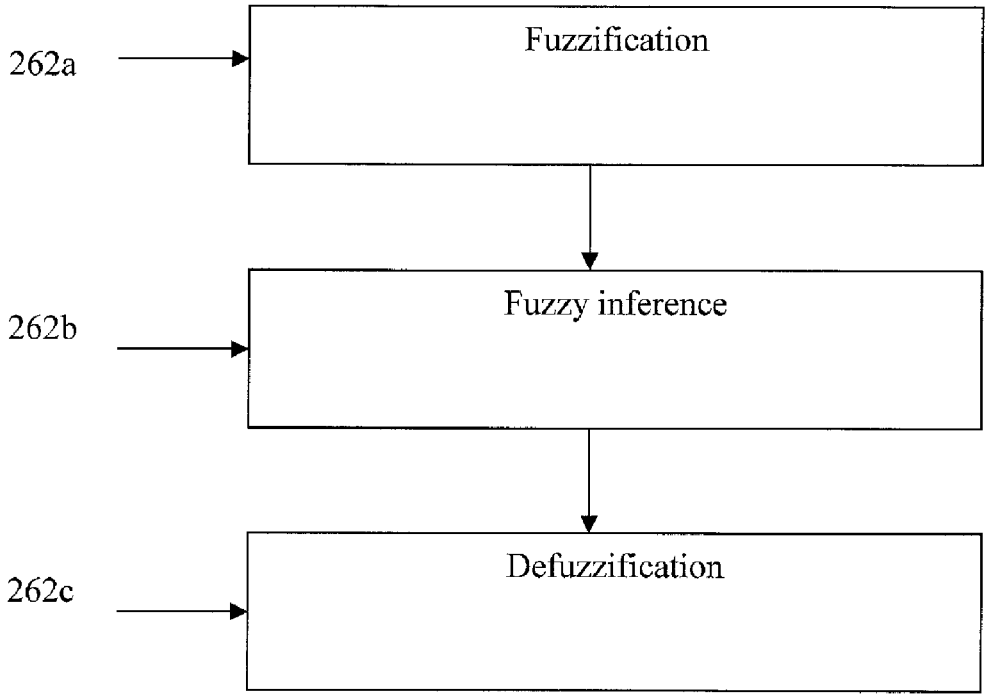
FIG. 2C is a flowchart illustrating the basic steps of a fuzzy logic algorithm.

In step 262, a black box algorithm, preferably a fuzzy logic algorithm is used to infer golf club design parameters from the input parameters. As illustrated in FIG. 2C, the application of a fuzzy logic algorithm, in step 262, generates a fuzzy logic model comprising three primary substeps: fuzzification (substep 262*a*), fuzzy inference (substep 262*b*), and defuzzification (substep 262*c*). These three primary substeps are discussed in greater detail after a brief background discussion of fuzzy logic. The application of fuzzy logic is described in detail in U.S. Pat. No. 6,421,612, which is incorporated herein by reference in its entirety.

Fuzzy logic was developed by Zadeh (Zadeh, *Information and Control,* 8: 338 (1965); Zadeh, *Information and Control,* 12: 94 (1968)) as a means of representing and manipulating data that is fuzzy rather than precise. The aforementioned publications are incorporated herein by reference in their entirety.

Central to the theory of fuzzy logic is the concept of a fuzzy set. In contrast to a traditional crisp set where an item either belongs to the set or does not belong to the set, fuzzy sets allow partial membership. That is, an item can belong to a fuzzy set to a degree that ranges from 0 to 1. A membership degree of 1 indicates complete membership, whereas a membership value of 0 indicates non-membership. Any value between 0 and 1 indicates partial membership. Fuzzy sets can be used to construct rules for fuzzy expert systems and to perform fuzzy inference.

Usually, knowledge in a fuzzy system is expressed as rules of the form "if x is A, then y is B," where x is an antecedent variable, y is a consequent variable, and A and B are fuzzy values. Fuzzy logic is the ability to reason (draw conclusions from facts or partial facts) using fuzzy sets, fuzzy rules, and fuzzy inference. Thus, following Yager's definition, a fuzzy model is a representation of the essential features of a system by the apparatus of fuzzy set theory (Yager and Filev, *Essentials of Fuzzy Modeling and Control*, Wiley (1994)). The aforementioned publication is incorporated herein by reference in its entirety.

Fuzzy logic has been employed to control complex or adaptive systems that defy exact mathematical modeling. Applications of fuzzy logic controllers range from cement-kiln process control, to robot control, image processing, motor control, camcorder auto-focusing, etc. However, as of to date, there has been no known use of fuzzy logic for inferring golf club design parameters. The use of fuzzy logic in golf club design would be advantageous because it can mimic the human reasoning of an expert golf club designer.

In the present invention, fuzzy logic algorithms generate fuzzy models that represent the essential features of the system using the apparatus of fuzzy set theory. In particular, a fuzzy model makes predictions using fuzzy rules describing the system of interest. A fuzzy rule is an IF-THEN rule with one or more antecedent and consequent variables. A fuzzy rule can be single-input-single-output (SISO), multiple-input-single-output (MISO), or multiple-input-multiple-output (MIMO). A fuzzy rule base is comprised of a collection of one or more such fuzzy rules. A MISO fuzzy rule base is of the form:

IF $x_1$ is $X_{11}$ AND $x_2$ is $X_{12}$ AND . . . AND $x_n$ is $X_{1n}$ THEN y is $Y_1$
ALSO
IF $x_1$ is $X_{21}$ AND $x_2$ is $X_{22}$ AND . . . AND $x_n$ is $X_{2n}$ THEN y is $Y_2$
ALSO
. . .
ALSO
IF $x_1$ is $X_{r1}$ AND $x_2$ is $X_{r2}$ AND . . . AND $x_n$ is $X_{rn}$ THEN y is $Y_r$, where $x_1, \ldots, x_n$ are the input variables, y is the output (dependent) variable, and $X_{ij}$, $Y_i$, i=(1, . . . , r), j=(1, . . . n) are fuzzy subsets of the universes of discourse of $X_1, \ldots, X_n$, and $Y_1, \ldots, Y_n$, respectively. The fuzzy model described above is referred to as a linguistic model.

Alternatively, a Takagi-Sugeno-Kang (TSK) model can be used. A TSK fuzzy rule base is of the form:

IF $x_1$ is $X_{11}$ AND $x_2$ is $X_{12}$ AND . . . AND $x_n$ is $X_{1n}$ THEN
$y=b_{10}+b_{11n1}+\ldots+b_{1n}x_n$
ALSO
IF $x_1$ is $X_{21}$ AND $x_2$ is $X_{22}$ AND . . . AND $x_n$ is $X_{2n}$ THEN
$y=b_{20}+b_{21x1}+\ldots+b_{2n}x_n$
ALSO
. . .
ALSO
IF $x_1$ is $X_{r1}$ AND $x_2$ is $X_{r2}$ AND . . . AND $x_n$ is $X_{rn}$ THEN
$y=b_{r0}+b_{r1}x_1+\ldots+b_{rn}x_n$ Thus, unlike a linguistic model that involves fuzzy consequents, a TSK model involves functional consequents, typically implemented as a linear function of the input variables.

Referring again to FIG. 2C, the illustration depicts a fuzzy logic model, which maps input variables (i.e., input parameters) to output variables (i.e., golf club design parameters) is illustrated. In fuzzification substep 262*a*, membership functions are used to transform input variables, which are usually crisp, to antecedent variables belonging to fuzzy sets wherein the degree of membership ranges from 0 to 1. For example, the input variable "handicap" can be transformed to an antecedent variable "handicap" with fuzzy sets designated by the terms "low," "medium," and "high." More particularly, for a hypothetical golfer, a handicap value of 6 may be transformed to membership 0.1 of "high," membership 0.5 of "medium" and membership 0.7 of "low," indicating that the golfer's handicap is not high, somewhat medium, and quite excellent.

In fuzzy inference substep 262*b*, a fuzzy rule base is applied to the fuzzy sets from substep 262*a*. Particularly, fuzzy inference substep 262*b* involves (1) applying a logical operator (e.g., AND) between the different antecedent variables of each rule, (2) implying the consequent variable for each rule, and (3) aggregating all consequent variables. Fuzzy inference substep 262*b* may also involve assigning a relative weight to each antecedent variable.

In defuzzification substep 262*c*, the aggregated consequent variables are transformed back to real variables using output fuzzy set definitions and a defuzzification strategy such as the mean-of-maximum method, the center-of-area method, or any other suitable defuzzification method known in the art.

4. Examples of Fuzzy Logic Models

Examples 1-11 below describe fuzzy logic models, designed according to the methodology of step 262, for the inference of a golf club design parameter from one or more input parameters. The inferred golf club design parameters include, but are not limited to, club style, offset, profile, top line width, finish, scoreline, loft, sole width, sole camber/leading edge radius, bounce angle, and lie angle. Other golf club design parameters can be added, and also linked to various input parameters, in order to enhance the final custom build request. Examples of additional golf club design parameters include weight, swing weight, face roughness, groove volume, hosel length, bore depth, set make up, material composition of the clubs, inertia, center of gravity, club decal/label. Similarly, the plurality of input parameters, which map to the plurality of golf club design parameters, are not limited to the ones discussed below. Other input parameters can be added to fine tune values for each club design parameter.

The Examples below are merely illustrative of certain embodiments of the invention. The Examples are not meant to limit the scope and breadth of the present invention, as recited in the appended claims.

EXAMPLE 1

Fuzzy Model for Inference of Club Style

A fuzzy logic model for the inference of club style is depicted in Table 2. The fuzzy logic model maps multiple input parameters including, but not limited to, values for a golfer's handicap, height preference for ball flight, club style preference, ball speed, and ball speed standard deviation to a single output value for club style preference. The output value for club style can include, but is not limited to, designs such as a muscle back design, mid-sized cavity back design, or oversized cavity back design. Table 2 also indicates the estimated relative percentage weight of each input parameter. The estimated relative percentage weight can also be thought of as the membership degree (between 0 and 1) or partial membership in the fuzzy set discussed above. The sum of all the partial memberships can be 1.0, or less than or greater than 1.0. Other values and percentage weights are possible.

Table 2 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values muscle back, cavity back, or oversized back. The defuzzification column indicates these possible output values, which are derived by a defuzzification strategy that transforms the aggregated consequent variables back into real variables. The fuzzy model illustrated in Table 2 is for illustrative purposes only. Other fuzzy models comprising different fuzzification, fuzzy inference, and defuzzification modules can also be used.

TABLE 2

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Club Style |
| Handicap ("X1"), 30% | <(−5), (−6)-(−12), (−13)-(−25) | High Medium Low | Rule 1: If X1 is "high" and X2 is "high" and X3 is "muscle back" and X4 is "high" and X5 is "high" then (Y1 or Y2 or Y3) | Y1 = Muscle back, Y2 = Cavity back, Y3 = Oversized back, |
| Height Preference for Ball Flight ("X2"), 5% | High, Medium, Low | High Medium Low | Rule 2: If X1 is "high" and X2 is "high" and X3 is "muscle back" and X4 is "high" and X5 is "medium" then (Y1 or Y2 or Y3). | |
| Club Style Preference ("X3"), 30% | Muscle Back, Cavity Back, Oversized | Muscle Back Cavity Back Oversized | Rule 3: If X1 is "high" and X2 is "high" and X3 is "muscle back" and X4 is "high" and X5 is "low" then (Y1 or Y2 or Y3). | |
| Ball Speed ("X4"), 5% | <110, 110-125, >125 | High Medium Low | Rule 4: If X1 is "high" and X2 is "high" and X3 is "muscle back" and X4 is "medium" and X5 is "high" then (Y1 or Y2 or Y3). | |
| Ball Speed Standard Deviation ("X5"), 30% | +/−1 mph, +/−3 mph, +/−5 mph | High Medium Low | . . . | |
| | | | Rule 242: If X1 is "low" and X2 is "low" and X3 is "oversized" and X4 is "low" and X5 is "medium" then (Y1 or Y2 or Y3). | |
| | | | Rule 243: If X1 is "low" and X2 is "low" and X3 is "oversized" and X4 is "low" and X5 is "low" then (Y1 or Y2 or Y3). | |

EXAMPLE 2

Fuzzy Model for Inference of Offset

A fuzzy logic model for the inference of offset is depicted in Table 3. The fuzzy logic model maps multiple input parameters including, but not limited to, values for height preference for ball flight, shape preference for ball flight, offset preference (for a 3-iron), departure angle/sidespin, path angle, and face angle to a single output value for offset. The output value for offset can include, but is not limited to, values such as 0.340, 0.240, and 0.140. Table 3 also indicates the estimated relative percentage weight of each input parameter. Other values and percentage weights are possible.

Table 3 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 0.340, 0.240, or 0.140 inches. The defuzzification column indicates these possible output values, which are derived by a defuzzification strategy that transforms the aggregated consequent variables back into real variables. The fuzzy model illustrated in Table 3 is for illustrative purposes only. Other fuzzy models comprising different fuzzification, fuzzy inference, and defuzzification modules can also be used.

EXAMPLE 3

Fuzzy Model for Inference of Profile

A fuzzy logic model for the inference of profile is depicted in Table 4. The fuzzy logic model maps a single input parameter for profile preference to a single output value for profile. The output value for profile can include, but is not limited to, values such as a round, traditional, or square profile. Although the illustrated fuzzy logic model relies on a single input parameter, it is possible for multiple input parameters, having different relative percentage weights, to influence the choice of a club's profile.

Table 4 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values round, traditional, or profile. The defuzzification column indicates these possible output values, which are derived by a defuzzification strategy that transforms the aggregated consequent variables back into real variables. The fuzzy model illustrated in Table 4 is for illustrative purposes only. Other fuzzy models comprising different fuzzification, fuzzy inference, and defuzzification modules can also be used.

TABLE 3

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Offset |
| Height Preference for Ball Flight ("X1"), 5% | High, Medium, Low | High<br>Medium<br>Low | Rule 1: If X1 is "high" and X2 is "fade" and X3 is "high" and X4 is "high" and X5 is "high" and X6 is "high" then (Y1 or Y2 or Y3). | Y1 = 0.340",<br>Y2 = 0.240", or<br>Y3 = 0.140" |
| Shape Preference for Ball Flight ("X2"), 5% | Fade, Straight, Draw | Fade<br>Straight<br>Draw | Rule 2: If X1 is "high" and X2 is "fade" and X3 is "high" and X4 is "high" and X5 is "high" and X6 is "medium" then (Y1 or Y2 or Y3). | |
| Offset Preference ("X3"), 25% | 0.340, 0.240, 0.140 inches | High<br>Medium<br>Low | Rule 3: If X1 is "high" and X2 is "fade" and X3 is "high" and X4 is "high" and X5 is "high" and X6 is "low" then (Y1 or Y2 or Y3). | |
| Departure Angle/ Sidespin ("X4"), 25% | 0°/<+/−200, +1.5°/−700, −1.5°/ +700 [units for sidespin?] | high<br>Medium<br>Low | Rule 4: If X1 is "high" and X2 is "fade" and X3 is "high" and X4 is "high" and X5 is "medium" and X6 is "high" then (Y1 or Y2 or Y3). | |
| Path Angle ("X5"), 30% | <−2, −2-+2, >+2 | High<br>Medium<br>Low | . . . | |
| Face Angle ("X6"), 10% | 2° Open, 0°, 2° Closed | High<br>Medium<br>Low | Rule 728: If X1 is "low" and X2 is "draw" and X3 is "low" and X4 is "low" and X5 is "low" and X6 is "medium" then (Y1 or Y2 or Y3).<br>Rule 729: If X1 is "low" and X2 is "draw" and X3 is "low" and X4 is "low" and X5 is "low" and X6 is "low" then (Y1 or Y2 or Y3). | |

TABLE 4

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Profile |
| Profile Preference ("X1"), 100% | Round, Traditional, Square | Round Traditional Square | Rule 1: If X1 is "round" then Y1 is round.<br>Rule 2: If X1 is "traditional" then Y2 is traditional.<br>Rule 3: If X1 "square" then Y3 is square. | Y1 = Round, Y2 = Traditional, or Y3 = Square |

EXAMPLE 4

Fuzzy Model for Inference of Top Line Width

A fuzzy logic model for the inference of top line width is depicted in Table 5. The fuzzy logic model maps multiple input parameters including, but not limited to, values for a golfer's handicap, top line width preference, and ball speed standard deviation to a single output value for top line width. The output value for top line width can include, but is not limited to, values such as 0.390, 0.290, and 0.190 inches. Table 5 also indicates the estimated relative percentage weight of each input parameter. Other values and percentage weights are possible.

Table 5 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 0.390, 0.290, or 0.190 inches. The defuzzification column indicates these possible output values, which are derived by a defuzzification strategy that transforms the aggregated consequent variables back into real variables. The fuzzy model illustrated in Table 5 is for illustrative purposes only. Other fuzzy models comprising different fuzzification, fuzzy inference, and defuzzification modules can also be used.

TABLE 5

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Top Line Width |
| Handicap ("X1"), 15%<br>Top Line Width Preference ("X2"), 70%<br>Ball Speed Standard Deviation ("X3"), 15% | <(−5),<br>(−6)-(−12),<br>(−13)-(−25)<br>0.390, 0.290, 0.190 inches<br>+/−1 mph,<br>+/−3 mph,<br>+/−5 mph | High<br>Medium<br>Low<br>High<br>Medium<br>Low<br>High<br>Medium<br>Low | Rule 1: If X1 is "high" and X2 is "high" and X3 is "high" then (Y1 or Y2 or Y3).<br>Rule 2: If X1 is "high" and X2 is "high" and X3 is "medium" then (Y1 or Y2 or Y3).<br>Rule 3: If X1 is "high" and X2 is "high" and X3 is "low" then (Y1 or Y2 or Y3).<br>Rule 4: If X1 is "high" and X2 is "medium" and X3 is "high" then (Y1 or Y2 or Y3).<br>. . .<br>Rule 26: If X1 is "low" and X2 is "low" and X3 is "medium" then (Y1 or Y2 or Y3).<br>Rule 27: If X1 is "low" and X2 is "low" and X3 is "low" then (Y1 or Y2 or Y3). | Y1 = 0.390",<br>Y2 = 0.290",<br>Y3 = 0.190" |

EXAMPLE 5

Fuzzy Model for Inference of Finish

A fuzzy logic model for the inference of finish is depicted in Table 6. The fuzzy logic model maps a single input parameter for finish preference to a single output value for finish. The output value for finish can include, but is not limited to, values such as scratch, satin, or bright. Although the illustrated fuzzy logic model relies on a single input parameter, it is possible for other input parameters, having different relative percentage weights, to influence the choice for a club's finish.

Table 6 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or 3 associated with output values scratch, satin, or bright. The defuzzification column indicates these possible output values, which are derived by a defuzzification strategy that transforms the aggregated consequent variables back into real variables. The fuzzy model illustrated in Table 6 is for illustrative purposes only. Other fuzzy models comprising different fuzzification, fuzzy inference, and defuzzification modules can also be used.

TABLE 6

FUZZY MODEL FOR INFERENCE OF FINISH

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Finish |
| Finish Preference ("X1"), 100% | Scratch, Satin, Bright | Scratch<br>Satin<br>Bright | Rule 1: If X1 is "scratch" then Y1 is scratch.<br>Rule 2: If X1 is "satin" then Y2 is satin.<br>Rule 3: If X1 "bright" then Y3 is bright. | Y1 = Scratch,<br>Y2 = Satin, or<br>Y3 = Bright |

EXAMPLE 6

Fuzzy Model for Inference of Scoreline

A fuzzy logic model for the inference of scoreline is depicted in Table 7. The fuzzy logic model maps multiple input parameters including, but not limited to, values for a golfer's handicap, height preference for ball flight, shape preference for ball flight, data about the conditions of fairways, ball speed, launch angle, ball speed standard deviation, departure angle/sidespin, and backspin to a single output value for scoreline. The output value for scoreline can include, but is not limited to, values such as U-shaped, U/V-shaped, or V-shaped. Table 7 also indicates the estimated relative percentage weight of each input parameter. Other values and percentage weights are possible.

Table 7 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values U-shaped, U/V-shaped, or V-shaped. The defuzzification column indicates these possible output values, which are derived by a defuzzification strategy that transforms the aggregated consequent variables back into real variables. The fuzzy model illustrated in Table 7 is for illustrative purposes only. Other fuzzy models comprising different fuzzification, fuzzy inference, and defuzzification modules can also be used.

TABLE 7

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Scoreline |
| Handicap ("X1"), 30% | <(−5),<br>(−6)-(−12),<br>(−13)-(−25) | High<br>Medium<br>Low | Rule 1: If X1 is "high" and X2 is "high" and X3 is "fade" and X4 is "soft" and X5 is "high" and X6 is "high" and X7 is "high" and X8 is "high" and X9 is "high" then (Y1 or Y2 or Y3). | Y1 = U-shaped,<br>Y2 = U/V-shaped, or Y3 = V-shaped |
| Height Preference for Ball Flight ("X2"), 5% | High, Medium, Low | High<br>Medium<br>Low | | |
| Shape Preference for Ball Flight ("X3"), 5% | Fade, Straight, Draw | Fade<br>Straight<br>Draw | Rule 2: If X1 is "high" and X2 is "high" and X3 is "fade" and X4 is "soft" and X5 is "high" and X6 is "high" and X7 is "high" and X8 is "high" and X9 is "medium" then (Y1 or Y2 or Y3). | |
| Course Conditions: Fairways ("X4"), 5% | Soft, Standard, Hard | Soft<br>Standard<br>Hard | | |
| Ball Speed ("X5"), 5% | <110 mph, 110-125 mph, >125 mph | High<br>Medium<br>Low | Rule 3: If X1 is "high" and X2 is "high" and X3 is "fade" and X4 is "soft" and X5 is "high" and X6 is "high" and X7 is "high" and X8 is "high" and X9 is "low" then (Y1 or Y2 or Y3). | |
| Launch Angle ("X6"), 10% | <12°, 12°-15°, 15°-18° | High<br>Medium<br>Low | | |

TABLE 7-continued

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Scoreline |
| Ball Speed Standard Deviation ("X7"), 5% | +/−1 mph, +/−3 mph, +/−5 mph, | High Medium Low | Rule 4: If X1 is "high" and X2 is "high" and X3 is "fade" and X4 is "soft" and X5 is "high" and X6 is "high" and X7 is "high" and X8 is "medium" and X9 is "high" then (Y1 or Y2 or Y3). | |
| Departure Angle/ Sidespin ("X8"), 5% | 0°/<+/−200, +1.5°/−700, −1.5°/+700, [units for sidespin?] | High Medium Low | . . . | |
| Backspin ("X9"), 30% | 4000, 5000, 6000 [units?] | High Medium Low | Rule 19682: If X1 is "low" and X2 is "low" and X3 is "draw" and X4 is "hard" and X5 is "low" and X6 is "low" and X7 is "low" and X8 is "medium" and X9 is "low" then (Y1 or Y2 or Y3). Rule 19683: If X1 is "low" and X2 is "low" and X3 is "draw" and X4 is "hard" and X5 is "low" and X6 is "low" and X7 is "low" and X8 is "low" and X9 is "low" then (Y1 or Y2 or Y3). | |

EXAMPLE 7

Fuzzy Model for Inference of Loft

A fuzzy logic model for the inference of loft is depicted in Table 8. The fuzzy logic model maps multiple input parameters including, but not limited to, values for a golfer's handicap, height preference for ball flight, ball speed, launch angle, backspin, angle of attack, and effective loft to a single output value for loft. The output value for loft can include, but is not limited to, values such as 32°, 30°, and 28°. Table 8 also indicates the estimated relative percentage weight of each input parameter. Other values and percentage weights are possible.

Table 8 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 32°, 30°, and 28°. The defuzzification column indicates these possible output values, which are derived by a defuzzification strategy that transforms the aggregated consequent variables back into real variables. The fuzzy model illustrated in Table 8 is for illustrative purposes only. Other fuzzy models comprising different fuzzification, fuzzy inference, and defuzzification modules can also be used.

TABLE 8

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Loft |
| Handicap ("X1"), 10% | <(−5), (−6)-(−12), (−13)-(−25) | High Medium Low | Rule 1: If X1 is "high" and X2 is "high" and X3 is "high" and X4 is "high" and X5 is "high" and X6 is "high" and X7 is "high" then (Y1 or Y2 or Y3). | Y1 = 32°, Y2 = 30°, and Y3 = 28° |
| Height Preference for Ball Flight ("X2"), 10% | High, Medium, Low | High Medium Low | Rule 2: If X1 is "high" and X2 is "high" and X3 is "high" and X4 is "high" and X5 is "high" and X6 is "high" and X7 is "medium" then (Y1 or Y2 or | |
| Ball Speed ("X3"), 15% | <110 mph, 110-125 mph, >125 mph | High Medium Low | | |

TABLE 8-continued

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Loft |
| Launch Angle ("X4"), 15% | <12°, 12°-15°, 15°-18° | High<br>Medium<br>Low | Y3).<br>Rule 3: If X1 is "high" and X2 is "high" and X3 is "high" and X4 is "high" and X5 is "high" and X6 is "high" and X7 is "low" then (Y1 or Y2 or Y3). | |
| Backspin ("X5"), 15% | 4000, 5000, 6000 [units?] | High<br>Medium<br>Low | | |
| Angle of Attack, 10% | <−6°, −6°-−9°, >−9° | High<br>Medium<br>Low | Rule 4: If X1 is "high" and X2 is "high" and X3 is "fade" and X4 is "high" and X5 is "high" and X6 is "medium" and X7 is "high" then (Y1 or Y2 or Y3). | |
| Effective Loft, 25% | Spec +4°, Spec, Spec −4° | High<br>Medium<br>Low | . . .<br>Rule 2186: If X1 is "low" and X2 is "low" and X3 is "low" and X4 is "low" and X5 is "low" and X6 is "low" and X7 is "low" and X8 is "medium" and X9 is "low" then (Y1 or Y2 or Y3).<br>Rule 2187: If X1 is "low" and X2 is "low" and X3 is "low" and X4 is "low" and X5 is "low" and X6 is "low" and X7 is "low" then (Y1 or Y2 or Y3). | |

EXAMPLE 8

Fuzzy Model for Inference of Sole Width

A fuzzy logic model for the inference of sole width is depicted in Table 9. The fuzzy logic model maps multiple input parameters including, but not limited to, values for a golfer's handicap, height preference for ball flight, club style preference, launch angle, ball speed standard deviation, and angle of attack to a single value for sole width. The output value for sole width can include, but is not limited to, values such as 0.85, 0.75, and 0.65 inches. Table 9 also indicates the estimated relative percentage weight of each input parameter. Other values and percentage weights are possible.

Table 9 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 0.85, 0.75, or 0.65. The defuzzification column indicates these possible output values, which are derived by a defuzzification strategy that transforms the aggregated consequent variables back into real variables. The fuzzy model illustrated in Table 9 is for illustrative purposes only. Other fuzzy models comprising different fuzzification, fuzzy inference, and defuzzification modules can also be used.

TABLE 9

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Sole Width |
| Handicap ("X1"), 25% | <(−5), (−6)-(−12), (−13)-(−25) | High<br>Medium<br>Low | Rule 1: If X1 is "high" and X2 is "high" and X3 is "muscle back" and X4 is "high" and X5 is "high" and X6 is "high" then (Y1 or Y2 or Y3). | Y1 = 0.850",<br>Y2 = 0.750",<br>Y3 = 0.650" |
| Height Preference for Ball Flight ("X2"), 10% | High, Medium, Low | High<br>Medium<br>Low | Rule 2: If X1 is "high" and X2 is "high" and X3 is "muscle | |

TABLE 9-continued

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Sole Width |
| Club Style Preference ("X3"), 10% | Muscle Back, Cavity Back, Oversized | Muscle Back Cavity Back Oversized | back" and X4 is "high" and X5 is "high" and X6 is "medium" then Y1 or Y2 or Y3). | |
| Launch Angle ("X4"), 5% | <12°, 12°-15°, 15°-18° | High Medium Low | Rule 3: If X1 is "high" and X2 is "high" and X3 is "muscle back" and X4 is "high" and X5 is"high" and X6 is "low" then (Y1 or Y2 or Y3). | |
| Ball Speed Standard Deviation ("X5"), 10% | +/−1 mph, +/−3 mph, +/−5 mph | High Medium Low | Rule 4: If X1 is "high" and X2 is "high" and X3 is "muscle back" and X4 is "high" and X5 is "medium" and X6 is "high" then (Y1 or Y2 or Y3). | |
| Angle of Attack ("X6"), 40% | <−6°, −6°-−9°, >−9° | High Medium Low | . . . | |
| | | | Rule 728: If X1 is "low" and X2 is "low" and X3 is "oversized" and X4 is "low" and X5 is "low" and X6 is "medium" then (Y1 or Y2 or Y3). | |
| | | | Rule 729: If X1 is "low" and X2 is "low" and X3 is "oversized" and X4 is "low" and X5 is "low" and X6 is "low" then (Y1 or Y2 or Y3). | |

EXAMPLE 9

Fuzzy Model for Inference of Sole Camber/Leading Edge Radius

A fuzzy logic model for the inference of sole camber/leading edge radius is depicted in Table 10. The fuzzy logic model maps multiple input parameters including, but not limited to, values for a golfer's handicap, ball speed standard deviation, angle of attack, and impact position/effective loft to a single value for sole camber/leading edge. The output value for sole camber/leading edge can include, but is not limited to, values such as 0.15, 0.12, and 0.09 inches. Table 10 also indicates the estimated relative percentage weight of each input parameter. Other values and percentage weights are possible.

Table 10 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 0.15, 0.12, or 0.09 inches. The defuzzification column indicates these possible output values, which are derived by a defuzzification strategy that transforms the aggregated consequent variables back into real variables. The fuzzy model illustrated in Table 10 is for illustrative purposes only. Other fuzzy models comprising different fuzzification, fuzzy inference, and defuzzification modules can also be used.

TABLE 10

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Sole Camber/ Leading Edge Radius |
| Handicap | <(−5), | High | Rule 1: If X1 is "high" and X2 | Y1 = 0.15", |

TABLE 10-continued

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Sole Camber/ Leading Edge Radius |
| ("X1"), 40% | (−6)-(−12), (−13)-(−25) | Medium Low | is "high" and X3 is "high" and X4 is "high" then (Y1 or Y2 or Y3). | Y2 = 0.12", Y3 = 0.09" |
| Ball Speed Standard Deviation ("X2"), 40% | +/−1 mph, +/−3 mph, +/−5 mph | High Medium Low | Rule 2: If X1 is "high" and X2 is "high" and X3 is "high" and X4 is "medium" then (Y1 or Y2 or Y3). | |
| Angle of Attack ("X3"), 10% | <−6°, −6°--9°, >−9° | High Medium Low | Rule 3: If X1 is "high" and X2 is "high" and X3 is "muscle back" and X4 is "low" then (Y1 or Y2 or Y3). | |
| Impact Position/ Effective Loft ("X4"), 10% | 0.1 <220°/92%, −0.1 <180°/92%, −0.1 <5°/88% | High Medium Low | Rule 4: If X1 is "high" and X2 is "high" and X3 is "medium" and X4 is "high" then (Y1 or Y2 or Y3). | |
| | | | . . . | |
| | | | Rule 80: If X1 is "low" and X2 is "low" and X3 is "low" and X4 is "medium" then (Y1 or Y2 or Y3). | |
| | | | Rule 81: If X1 is "low" and X2 is "low" and X3 is "low" and X4 is "low" then (Y1 or Y2 or Y3). | |

EXAMPLE 10

Fuzzy Model for Inference of Bounce Angle

A fuzzy logic model for the inference of bounce angle is depicted in Table 11. The fuzzy logic model maps multiple input parameters including, but not limited to, values for a golfer's handicap, height preference for ball flight, data about the conditions of fairways, launch angle, and angle of attack to a single value for bounce angle. The output value for bounce angle can include, but is not limited to, values such as 6°, 4°, and 2°. Table 11 also indicates the estimated relative percentage weight of each input parameter. Other values and percentage weights are possible.

Table 11 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values 6°, 4°, or 2°. The defuzzification column indicates these possible output values, which are derived by a defuzzification strategy that transforms the aggregated consequent variables back into real variables. The fuzzy model illustrated in Table 11 is for illustrative purposes only. Other fuzzy models comprising different fuzzification, fuzzy inference, and defuzzification modules can also be used.

TABLE 11

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Bounce Angle |
| Handicap ("X1"), 15% | <(−5), (−6)-(−12), (−13)-(−25) | High Medium Low | Rule 1: If X1 is "high" and X2 is "high" and X3 is "soft" and X4 is "high" and X5 is "high" then (Y1 or Y2 or Y3). | Y1 = 6°, Y2 = 4°, and Y3 = 2° |
| Height Preference for Ball Height ("X2"), 5% | High, Medium, Low | High Medium Low | Rule 2 If X1 is "high" and X2 is "high" and X3 is "soft" and X4 is "high" and X5 is "medium" then | |
| Course Conditions: | Soft, Standard, | Soft Standard | | |

TABLE 11-continued

| Fuzzification | | | | |
|---|---|---|---|---|
| Input Parameter, Estimated Relative % Weight | Universe of Discourse: Sample Values | Fuzzy Sets | Fuzzy Inference: Sample Fuzzy Rules | Defuzzification: Output Values for Bounce Angle |
| Fairways ("X3"), 25% | Hard | Hard | (Y1 or Y2 or Y3). Rule 3: If X1 is "high" and X2 is "high" and X3 is "soft" and X4 is "high" and X5 is "low" then (Y1 or Y2 or Y3). Rule 4: If X1 is "high" and X2 is "high" and X3 is "soft" and X4 is "medium" and X5 is "high" then (Y1 or Y2 or Y3). . . . Rule 242: If X1 is "low" and X2 is "low" and X3 is "hard" and X4 is "low" and X5 is "medium" then (Y1 or Y2 or Y3). Rule 243: If X1 is "low" and X2 is "low" and X3 is "hard" and X4 is "low" and X5 is "low" then (Y1 or Y2 or Y3). | |
| Launch Angle ("X4"), 5% | <12°, 12°-15°, 15°-18° | High Medium Low | | |
| Angle of Attack ("X5"), 50% | <−6°, −6°--9°, >−9° | High Medium Low | | |

EXAMPLE 11

Fuzzy Model for Inference of Lie Angle

A fuzzy logic model for the inference of lie angle is depicted in Table 12. The fuzzy logic model maps multiple input parameters including, but not limited to, values for knuckle to ground height, impact position/effective loft, and sole angle to a single output value for lie angle. The output value for lie angle can include, but is not limited to, values such as +2°, Standard, −2°. Table 12 also indicates the estimated relative percentage weight of each input parameter. Other values and percentage weights are possible.

Table 12 is divided into three main columns corresponding to the three primary components of a fuzzy model: fuzzification, fuzzy inference, and defuzzification. The fuzzification column indicates examples of possible fuzzy sets and sample universe of discourse values associated with each input parameter. The fuzzy inference column indicates sample fuzzy rules that are applied to the fuzzy sets. The fuzzy rules are used to imply fuzzy consequent variables Y1, Y2, or Y3 associated with output values +2°, Standard, −2°. The defuzzification column indicates these possible output values, which are derived by a defuzzification strategy that transforms the aggregated consequent variables back into real variables. The fuzzy model illustrated in Table 12 is for illustrative purposes only. Other fuzzy models comprising different fuzzification, fuzzy inference, and defuzzification modules can also be used.

TABLE 12

| FUZZY MODEL FOR INFERENCE OF LIE ANGLE | | | | |
|---|---|---|---|---|
| Fuzzification | | | | |
| Input Parameter, Estimated Relative % Weight | Universe of Discourse: Sample Values | Fuzzy Sets | Fuzzy Inference: Sample Fuzzy Rules | Defuzzification: Output Values for Lie Angle |
| Knuckle to Ground Height ("X1"), 50% | 28", 30", 32" | High Medium Low | Rule 1: If X1 is "high" and X2 is "high" and X3 is "high" then (Y1 or Y2 or Y3). Rule 2: If X1 is "high" and X2 is "high" and X3 is "medium" then (Y1 or Y2 or Y3). Rule 3: If X1 is "high" and X2 is "high" and X3 is "low" then (Y1 or Y2 or Y3). Rule 4: If X1 is "high" and X2 | Y1 = +2°, Y2 = Standard, Y3 = −2° |
| Impact Position/ Effective Loft ("X2"), 10% | 0.1 <220°/92%, 0.1 <180°/92%, −0.1 <5°/88% | High Medium Low | | |
| Sole Contact ("X3"), 40% | 0.1H, 0.1 Aft, 0.2T, 0 Aft, | High Medium | | |

TABLE 12-continued

| FUZZY MODEL FOR INFERENCE OF LIE ANGLE | | | | |
|---|---|---|---|---|
| | Fuzzification | | | |
| Input Parameter, Estimated Relative % Weight | Universe of Discourse: Sample Values | Fuzzy Sets | Fuzzy Inference: Sample Fuzzy Rules | Defuzzification: Output Values for Lie Angle |
| | 0.1H, O.1 Fwd | Low | is "medium" and X3 is "high" then (Y1 or Y2 or Y3).<br>. . .<br>Rule 26: If X1 is "low" and X2 is "low" and X3 is "medium" then (Y1 or Y2 or Y3).<br>Rule 27: If X1 is "low" and X2 is "low" and X3 is "low" then (Y1 or Y2 or Y3). | |

III. Computer Aided Design and Manufacturing of Golf Clubs

Referring now to FIG. 3, which illustrates the various steps of phase 300, the golf club design parameters from phase 200 are used by the manufacturing system 108, comprising a computer aided design and computer aided manufacturing (CAD/CAM) system, to create new parametric CAD/CAM models of golf clubs in step 302. Alternatively, the golf club design parameters from phase 200 are best-fitted to pre-existing parametric CAD/CAM models in step 302. Golf club design parameters developed according to the second embodiment can be used to create new or best-fit pre-existing CAD/CAM models, whereas golf club design parameters developed according to the first embodiment are best-fitted to pre-existing CAD/CAM models.

In step 304, the parametric CAD/CAM models can be securely transmitted from the manufacturing system 108 to the user computing system 102 via network 110. In step 306, the user computing system receives and decrypts, decodes and/or otherwise gains access to the parametric CAD/CAM models. In step 308, the user makes a decision about parametric CAD/CAM models. In step 308, the user may have multiple decisional options, including approval, or disapproval with modification. In step 310, the user's decision is transmitted from the user computing system to the manufacturing system 108 via network 110. In step 312, the manufacturing system 108 receives and decrypts, decodes and/or otherwise gains access to the user decision. In step 314, the manufacturing system evaluates the user' decision. If the user's decision indicates disapproval of the parametric CAD/CAM models, then the parametric CAD/CAM models are modified in step 316 and, subsequently steps 304-316 can be repeated until the user approves the parametric CAD/CAM models. When the user's decision indicates approval of the parametric CAD/CAM models, then phase 300 is terminated in step 318.

Referring back to FIG. 1B, in phase 400, a factory machine program is generated for fabricating golf club heads. According to one embodiment, a factory machine program can be generated for the operation of a computer numerically controlled (CNC) milling machine. A CNC milling program can be generated using an integrated CAD/CAM methodology such as associative machining. Alternatively, one can manually program the CNC milling machine, or one can program it using a Notepad® file. According to another embodiment, a factory machine program can be generated for a rapid-prototyping machine using any suitable method known to one of ordinary skill in the art In phase 500, machine 112 fabricates golf clubs. According to one embodiment, machine 112 is a CNC milling machine that mills golf club heads using the factory machine program generated in phase 400. The milling process can include the use of pre-determined blanks for each head to minimize machining time and cost. Moreover, machining fixtures and machining processes can be optimized for maximum efficiency and flexibility. Subsequently, the milled heads can be provided with finishes including, but not limited to, standard matte or chrome finishes or custom finishes (e.g., oil can finishes). According to another embodiment, machine 112 is a rapid prototype machine that fabricates golf club heads using the factory machine program generated in phase 400.

Finally, in phase 600, the desired golf clubs are assembled using the fabricated golf club heads and other golf club components such as shafts and grips.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with feature(s) and/or element(s) from other embodiment(s). Therefore, it will be understood that the appended claims are intended to cover all such modifications and embodiments, which would come within the spirit and scope of the present invention.

The invention claimed is:

1. A method for constructing one or more golf clubs comprising the steps of:

a. capturing input data values for a plurality of input parameters corresponding to a golfer's performance needs and preferences; the plurality of input parameters being selected from a group comprising club head speed, ball speed, launch angle, backspin, spin rate, effective loft, and face angle;

b. drawing inferences about golf club design parameters from said plurality of input parameters, wherein the inferences are made by a processor programed to use an algorithm comprising the steps of:

i. providing one or more membership functions to transform the input data into antecedent variables;

ii. assigning weights to the antecedent variables;

iii. determining a consequence variable based on the antecedent variables and the relative weights associated with each of the antecedent variables;

iv. drawing inferences based on the consequence variables utilizing the algorithm, c. developing one or more computer models based on the inferences about the one or more golf club design parameters; and d. operating a machine configured to fabricate one or more golf club heads according to the one or more computer models.

2. The method of claim 1, wherein the algorithm is used to infer offset from club style from values for a golfer's handicap, height preference for ball flight, club style preference, ball speed, and ball speed standard deviation.

3. The method of claim 1, wherein the algorithm is used to infer offset from values for height preference for ball flight, shape preference for ball flight, offset preference, departure angle/sidespin, path angle, and face angle.

4. The method of claim 1, wherein the algorithm is used to infer profile from a golfer's profile preference.

5. The method of claim 1, wherein the algorithm is used to infer scoreline from values for a golfer's handicap, height preference for ball flight, shape preference for ball flight, data about the conditions of fairways, ball speed, launch angle, ball speed standard deviation, departure angle/sidespin, and backspin.

6. The method of claim 1, wherein the algorithm is used to infer loft from values for a golfer's handicap, height preference for ball flight, ball speed, launch angle, backspin, angle of attack, and effective loft.

7. The method of claim 1, wherein the algorithm is used to infer sole width from values for a golfer's handicap, height preference for ball flight, club style preference, launch angle, ball speed standard deviation, and angle of attack.

8. The method of claim 1, wherein the algorithm is used to infer sole camber/leading edge radius from values for a golfer's handicap, ball speed standard deviation, angle of attack, and impact position/effective loft.

9. The method of claim 1, wherein the algorithm is used to infer bounce angle from values for a golfer's handicap, height preference for ball flight, data about the conditions of fairways, launch angle, and angle of attack.

10. A method for interactively constructing one or more golf clubs comprising the steps of:

a. capturing preferences for one or more golf club design parameters by a method comprising the steps of:

i. providing a graphical user interface;

ii. displaying a representative golf club on the graphical user interface;

iii. positing a series of questions about one or more golf club design parameters;

iv. obtaining responses to the series of questions;

v. instantaneously modifying the displayed representative golf club in three-dimension on the graphical user interface as the one or more preferred options is being customized;

b. best-fitting one or more computer aided design models based on the captured preferences for one or more golf club design parameters; and c. operating a machine to fabricate one or more golf club heads according to the design models, wherein step b) further comprises the steps of:

i. providing one or more membership functions to transform the captured preferences into antecedent variables belonging to fuzzy sets;

ii. applying fuzzy rules to the fuzzy sets by steps comprising:

1. assigning a relative weight to each antecedent variable;

2. applying a logical operator between the different antecedent variables of each rule;

3. implying a consequent variable for each rule;

4. aggregating all consequent variables; and iii. defuzzifying the consequent variables into crisp variables.

11. The method of claim 10, wherein the golf club design parameters comprises at least one of, a profile, a bounce angle, a sole camber, a leading edge radius, a sole width, a groove design, a top line width, a crown radius, an offset, and finish.

12. The method of claim 11, wherein the modification of the displayed representative golf club occurs instantaneously based on the response to the series of questions.

13. The method of claim 10, further comprising the step capturing input data corresponding to a golfer's performance needs selected from the group comprising club head speed, ball speed, launch angle, backspin, spin rate, effective loft and face angle.

14. The method of claim 10, wherein step c) comprises operating a machine that is either a computer numerically controlled (CNC) machine, or a rapid prototype machine.

* * * * *